US010960687B2

(12) United States Patent
Nemoto et al.

(10) Patent No.: US 10,960,687 B2
(45) Date of Patent: Mar. 30, 2021

(54) IMAGE FORMING APPARATUS

(71) Applicant: FUJI XEROX CO., LTD., Tokyo (JP)

(72) Inventors: Zentaro Nemoto, Kanagawa (JP); Yuichi Sono, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/506,982

(22) Filed: Jul. 9, 2019

(65) Prior Publication Data

US 2020/0282748 A1 Sep. 10, 2020

(30) Foreign Application Priority Data

Mar. 5, 2019 (JP) ..... JP2019-039194

(51) Int. Cl.
*B41J 11/00* (2006.01)
*G03G 15/00* (2006.01)

(52) U.S. Cl.
CPC ..... *B41J 11/0065* (2013.01); *G03G 15/5029* (2013.01)

(58) Field of Classification Search
CPC ..... B41J 11/0065; G03G 15/5029
See application file for complete search history.

(56) References Cited

U.S. PATENT DOCUMENTS

| | | | | |
|---|---|---|---|---|
| 6,203,220 | B1 * | 3/2001 | Takenoshita | B41J 3/28 235/375 |
| 8,009,317 | B2 | 8/2011 | Nagata | |
| 8,320,014 | B2 | 11/2012 | Nagata | |
| 8,767,267 | B2 * | 7/2014 | Yanagi | G03G 15/231 358/3.26 |
| 2005/0271437 | A1 * | 12/2005 | Edamura | B41J 11/0065 400/76 |

FOREIGN PATENT DOCUMENTS

| | | |
|---|---|---|
| JP | 2004104190 | 4/2004 |
| JP | 2006220991 | 8/2006 |
| JP | 4708668 | 6/2011 |

* cited by examiner

*Primary Examiner* — Sharon Polk
(74) *Attorney, Agent, or Firm* — JCIPRNET

(57) ABSTRACT

An image forming apparatus includes a transport unit that transports a recording medium along a transport path to a formation area in which an image is formed on the recording medium, an image forming unit that forms the image on the recording medium in the formation area, and a protrusion amount setting unit that sets a protrusion amount of the image protruding from the recording medium to a first protrusion amount in a first case, and sets the protrusion amount to a second protrusion amount larger than the first protrusion amount in a second case where the recording medium is inclined to a transport direction more than the first case.

3 Claims, 19 Drawing Sheets

(B)

(A)

(A)

(B)

(A)

(B)

(A)

(B)

(A)

(B)

IMAGE FORMING APPARATUS

CROSS-REFERENCE TO RELATED APPLICATIONS

This application is based on and claims priority under 35 USC 119 from Japanese Patent Application No. 2019-039194 filed Mar. 5, 2019.

BACKGROUND

(i) Technical Field

The present invention relates to an image forming apparatus.

(ii) Related Art

In the related art, in order to perform so-called borderless printing, a technique is known which prints an image larger than the size of a sheet so as to be projected from the sheet.

In such borderless printing, in a case where the protrusion amount of the image protruding from the sheet is large, the sheet falls within the image even in a case where the position of the sheet is shifted, so the border of the sheet is prevented from being white out.

On the other hand, in a case where the protrusion amount is large, the useless image portion not placed on the sheet is large, so the consumption amount and the recovery amount of the ink and toner forming the image are large, which is not desirable from the viewpoint of cost and life.

Therefore, an image forming apparatus capable of adjusting the protrusion amount has been proposed.

For example, JP2004-104190A discloses an apparatus which causes the user to set a protrusion amount corresponding to the size of an image which protrudes from the recording sheet and is not recorded due to enlargement of an original image, in a case where the original image is recorded on a recording sheet in a borderless copy mode, and determines a magnification for the enlargement, based on the protrusion amount set by a user.

Further, JP2006-220991A discloses an apparatus that controls the protrusion amount of a plurality of toner images, based on the detection result of a passage detection unit that detects the passage of the leading edge position or the trailing end position of the recording material, in a case of performing borderless printing.

Further, JP4708668B discloses an apparatus which can designate one of a plurality of protrusion levels representing the protrusion amount, according to the user's instruction, and sets a combination of the protrusion amount from each end which is associated in advance with the protrusion level, according to the designated protrusion level.

SUMMARY

However, in the apparatus in the related art, a phenomena in which white spots occur near the corners of the recording medium due to a so-called skew, that is, a recording medium represented by a sheet is inclined to the transport direction has not been considered, and setting of a protrusion amount corresponding to the skew has not been proposed.

Aspects of non-limiting embodiments of the present disclosure relate to an image forming apparatus capable of setting an appropriate protrusion amount even in a case where a skew occurs.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including:

a transport unit that transports a recording medium along a transport path to a formation area in which an image is formed on the recording medium;

an image forming unit that forms the image on the recording medium in the formation area; and a protrusion amount setting unit that sets a protrusion amount of the image protruding from the recording medium to a first protrusion amount in a first case, and sets the protrusion amount to a second protrusion amount larger than the first protrusion amount in a second case where the recording medium is inclined to a transport direction more than the first case.

BRIEF DESCRIPTION OF THE DRAWINGS

Exemplary embodiment(s) of the present invention will be described in detail based on the following figures, wherein.

DETAILED DESCRIPTION

Hereinafter, exemplary embodiments of the present invention will be described in detail with reference to the accompanying drawings.

Figure 1:
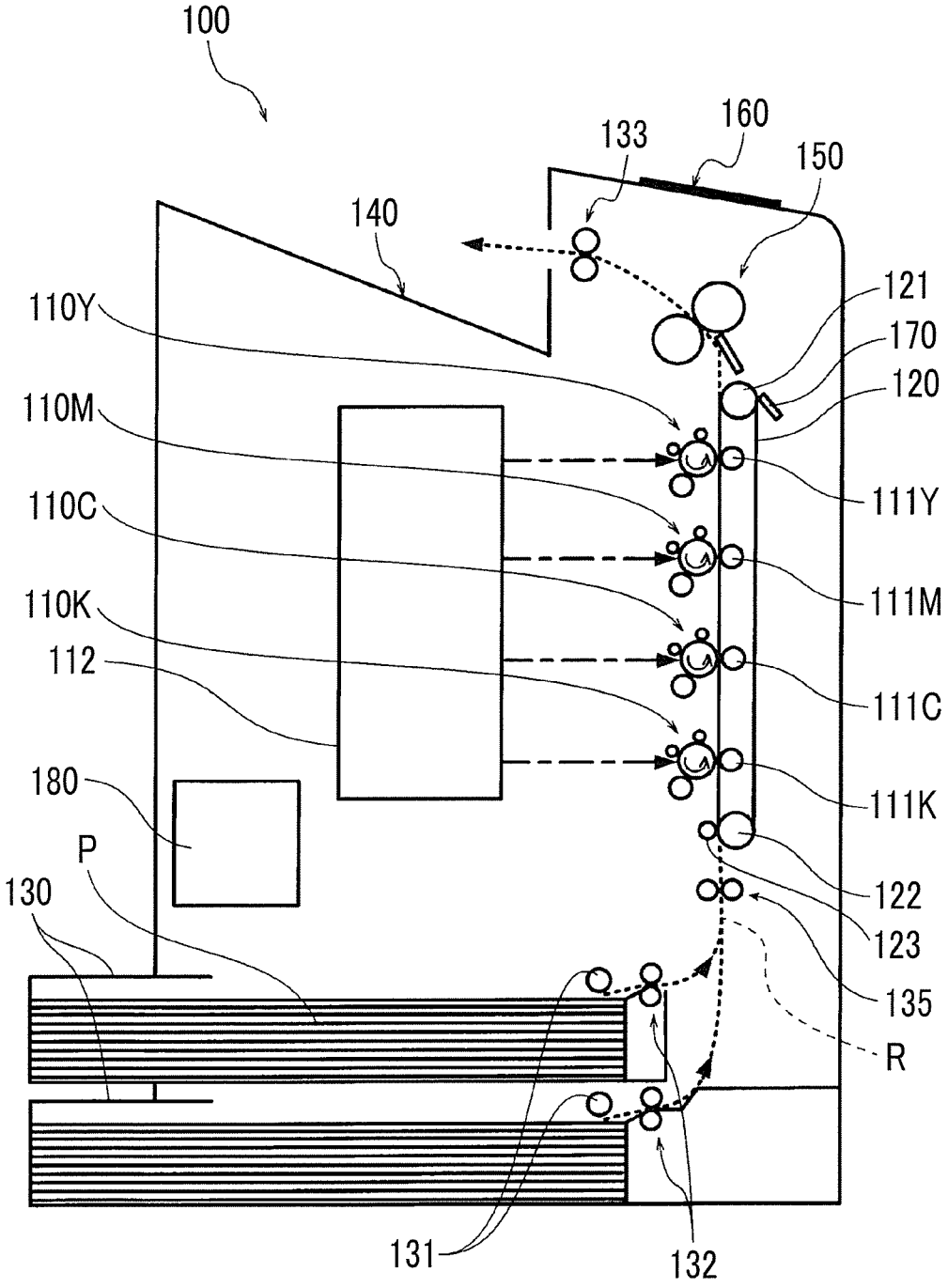
FIG. 1 is a schematic configuration diagram showing a first exemplary embodiment of an image forming apparatus.

FIG. 1 is a schematic configuration diagram showing a first exemplary embodiment of an image forming apparatus.

The image forming apparatus 100 shown in FIG. 1 is a so-called tandem type color printer, and in the image forming apparatus 100, a cut sheet P is used as a recording material. In addition to the cut sheet P, plastic sheet and an envelope may be adopted as the recording material, but in the following description, the cut sheet P will be described as a representative of the recording material.

The cut sheets P are stored in a stacked state on a sheet tray 130 provided at the lower part of the image forming apparatus 100. The cut sheets P in the sheet tray 130 are taken out one by one from the sheet tray 130 by the feed roll 131 and the separating roll 132 and transported upward along the transport path R.

In the case of the present exemplary embodiment, sheet trays 130 of two stages are provided. The sheet trays 130 may store cut sheets P of different sizes, respectively. Further, shapes of the cut sheet P that can be stored in the sheet tray 130 include a rounded corner shape in which the corners are cut, in addition to a normal shape in which the corners are cut at right angles. Of the sheet trays 130 of two stages, the cut sheet P of the sheet tray 130 selected by the user is used for image formation.

The image forming apparatus 100 is provided with, for example, four image engines 110Y, 110M, 110C, 110K corresponding to four colors of yellow (Y), magenta (M), cyan (C), black (K). Further, in the present exemplary embodiment, each of the image engines 110Y, . . . , 110K forms a toner image by a so-called electrophotographic method. In each of the image engines 110Y, . . . , 110K, a toner image of each color is formed on each photoconductive drum by sequentially passing through the steps of charging, exposure, and development. In the present exemplary embodiment, the exposure step is performed by the exposure light emitted from one exposure apparatus 112 common to the four image engines 110Y, . . . , 110K.

In the image forming apparatus 100 of the present exemplary embodiment, a direct transfer method is adopted, and a sheet transport belt 120 is provided. The sheet transport belt 120 is wound around a driving roll 121 and a driven roll 122, and is circulated by the driving force of the driving roll 121 through the respective image engines 110Y, . . . , 110K. At a position facing the driven roll 122 with the sheet transport belt 120 interposed therebetween, an auxiliary roll 123 for assisting the transport of the cut sheet P by the sheet transport belt 120 is provided. The combination of the sheet transport belt 120 and the feed roll 131 corresponds to an example of the transport unit in the present invention.

Transfer rolls 111Y, 111M, 111C, 111K are disposed at respective positions facing the image engines 110Y, . . . , 110K with the sheet transport belt 120 interposed therebetween. After the cut sheets P taken out from the sheet tray 130 and transported along the transport path R pass through the registration roll 135, the cut sheets P are transported by the sheet transport belt 120, and pass between the image engines 110Y, . . . , 110K and the transfer rolls 111Y, . . . , 111K. The toner images of the respective colors formed by the respective image engines 110Y, 110K are sequentially superimposed and transferred onto the cut sheet P by the respective transfer rolls 111Y, 111K. As a result of such transfer, a color image is formed on the cut sheet P. The registration roll 135 temporarily stops the cut sheet P, and sends the cut sheet P to the sheet transport belt 120 at the same timing as image formation by the image engines 110Y, . . . , 110K.

A combination of the image engine and the transfer roll corresponds to an example of the image forming device according to the exemplary embodiment of the present invention, and an area between the image engine 110Y, 110K and the transfer roll 111Y, . . . , 111K corresponds to an example of the formation area in the present invention.

The image forming apparatus 100 is provided with a fixing device 150, and the color image on the cut sheet P is fixed by heat and pressure by the fixing device 150. The cut sheet P on which the image is fixed by the fixing device 150 is sent out by the delivery roll 133 to the stacking tray 140 on the housing.

On the upper surface of the image forming apparatus 100, a display panel 160 is provided which is responsible for inputting information and instructions to the image forming apparatus 100 by the user, and displaying information from the image forming apparatus 100 to the user.

The image forming apparatus 100 further includes a cleaner 170 for scraping unnecessary things such as toner and sheet dust from the sheet transport belt 120 with a blade, and a control unit 180 that controls each unit in the image forming apparatus 100.

The image forming apparatus 100 of the present exemplary embodiment is provided with a so-called borderless printing function of forming an image on the entire surface of the cut sheet P. This borderless printing is realized by forming a toner image of a size exceeding the size of the cut sheet P by the image engines 110Y, . . . , 110K.

Figure 2:
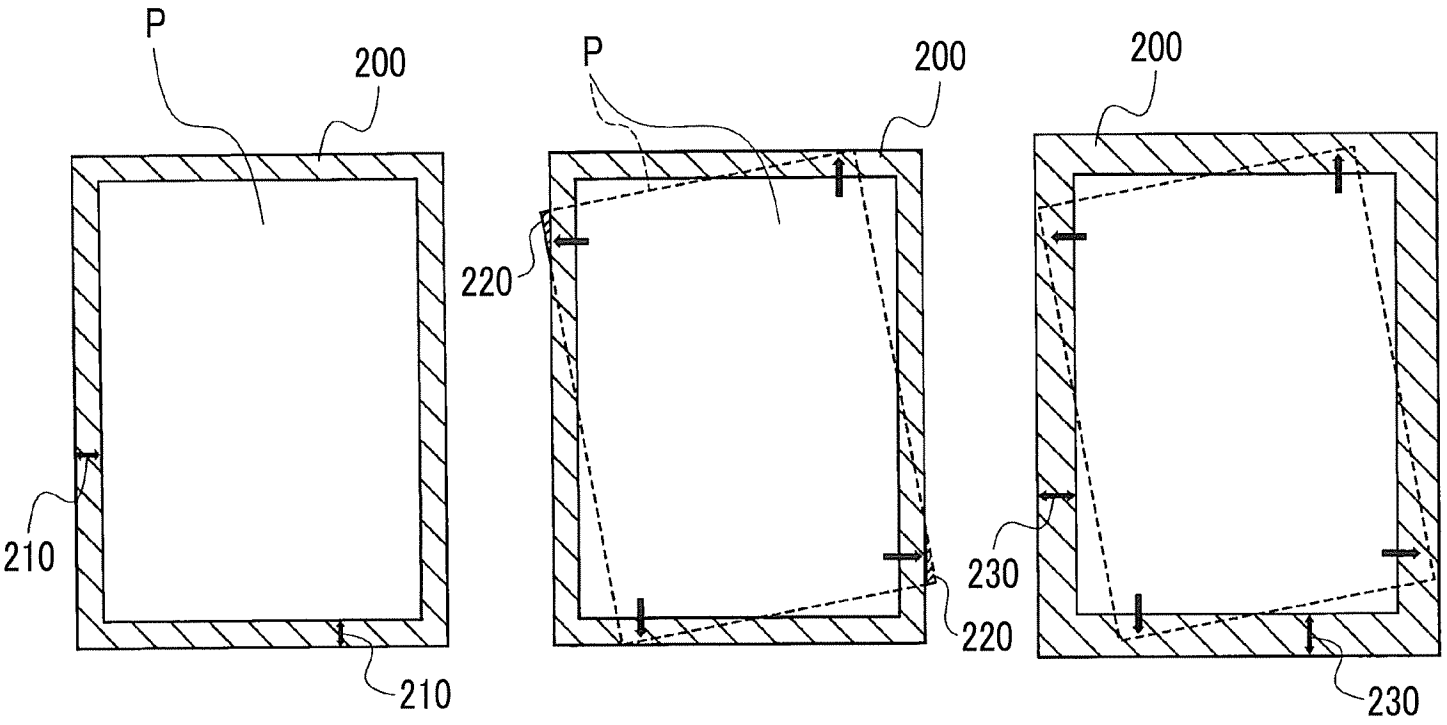
FIG. 2 is an explanatory view of borderless printing.

FIG. 2 is an explanatory view of borderless printing.

In the borderless printing at the normal time (A), the range of the cut sheet P fits in the range of the toner image 200, so an image is formed on the entire surface of the cut sheet P. Hereinafter, the width of the portion where the range of the toner image 200 exceeds the range of the cut sheet P will be referred to as a protrusion amount 210. As the protrusion amount 210, different amounts in the vertical direction and the horizontal direction of the cut sheet P may be adopted, but for the sake of simplicity of description, the cut sheet P will be described below as having the identical protrusion amount 210 in the vertical direction and the horizontal direction. The protrusion amount 210 at the normal time (A) is, for example, 2 mm.

In a case where the cut sheet P is taken out of the sheet tray 130 and travels along the transport path R, a so-called skew may occur in the transport direction. At the skew time (B), as shown by the arrows in FIG. 2, the corner portions of the cut sheet P are displaced to the outside than at the normal time (A). In a case where the skew is small, the positional deviation of the corner portion is small, so the entire surface of the cut sheet P falls within the range of the toner image 200. However, in a case where the skew is large, a whiteout area 220 that protrudes beyond the range of the toner image 200 at the corner portion of the cut sheet P. At the countermeasure time (C) for preventing the occurrence of such a whiteout area 220, a protrusion amount 230 wider than that at the normal time (A) is used. The protrusion amount 230 at the countermeasure time (C) is, for example, 3 mm. However, such a wide protrusion amount 230 causes an increase in toner consumption amount. Further, the toner of the toner image 200 which has exceeded the range of the cut sheet P is scraped off by the cleaner 170 from above the sheet transport belt 120 and is collected by a collection mechanism (not shown). The wide protrusion amount 230 causes an increase in the amount of collected toner and shortens the life of the apparatus. Therefore, the protrusion amount 210 at the normal time (A) and the protrusion amount 230 at the countermeasure time (C) can be selectively used according to the magnitude of the skew.

Here, the occurrence and correction of skew will be described.

Figure 3:
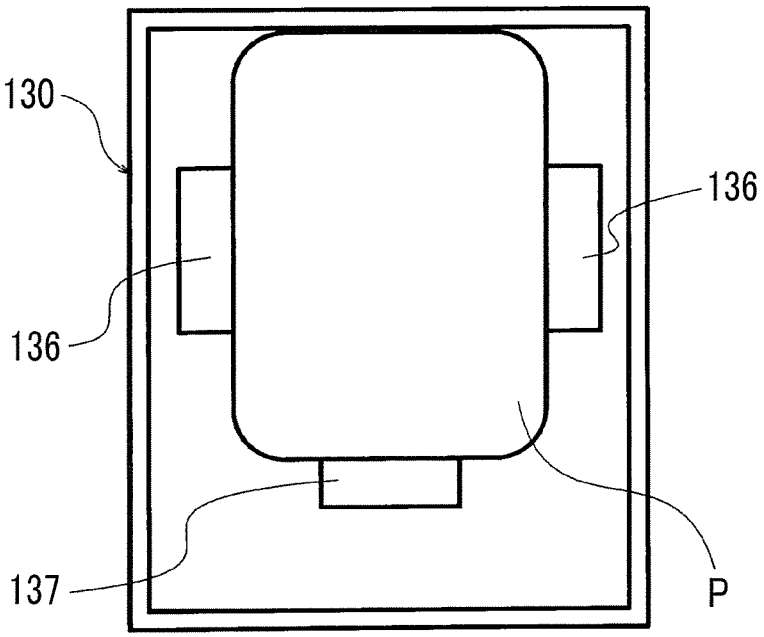
FIG. 3 is a view showing a sheet tray storing cut sheets.

FIG. 3 is a view showing a sheet tray storing cut sheets.

The sheet tray 130 is provided with a side guide 136 and an end guide 137 as movable guides in order to cope with cut sheets P of a plurality of sizes. The direction of the cut sheet P is turned to the transport direction by the side guide 136.

Figure 4:
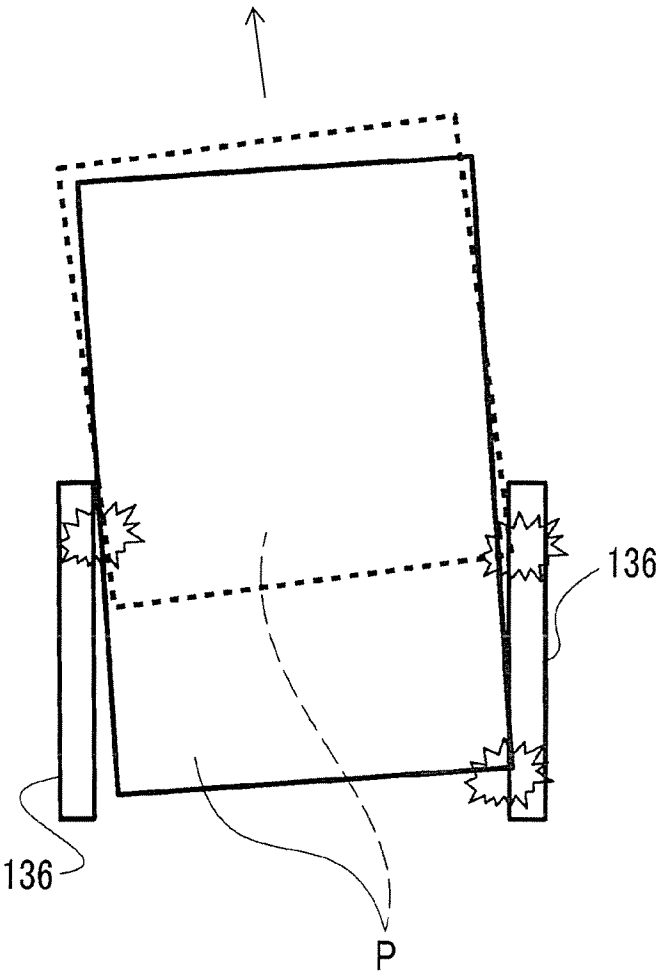
FIG. 4 is a view showing a state of occurrence of a skew.

FIG. 4 is a view showing a state of occurrence of a skew.

Although the direction of the cut sheet P is turned to the transport direction by contact with the side guides 136 on both sides, a slight gap may be generated between the cut sheet P and the side guide 136, and the cut sheet P may be inclined by the gap. In a case where the cut sheet P is inclined as described above, in a case where the cut sheet P is taken out in the direction of the arrow in the drawing, the inclination may be enlarged and a skew may occur. In addition, comparing a case where the length of the cut sheet P is short as indicated by the dotted line with a case where the length of the cut sheet P is long as indicated by the solid line, even in a case where the gap between the cut sheet P and the side guide 136 is substantially the same, the cut sheet P having a short length tends to have a larger inclination. As a result, as a general tendency, the cut sheet P having a short length generates a larger skew as compared with the cut sheet P having a long length.

Figure 5:
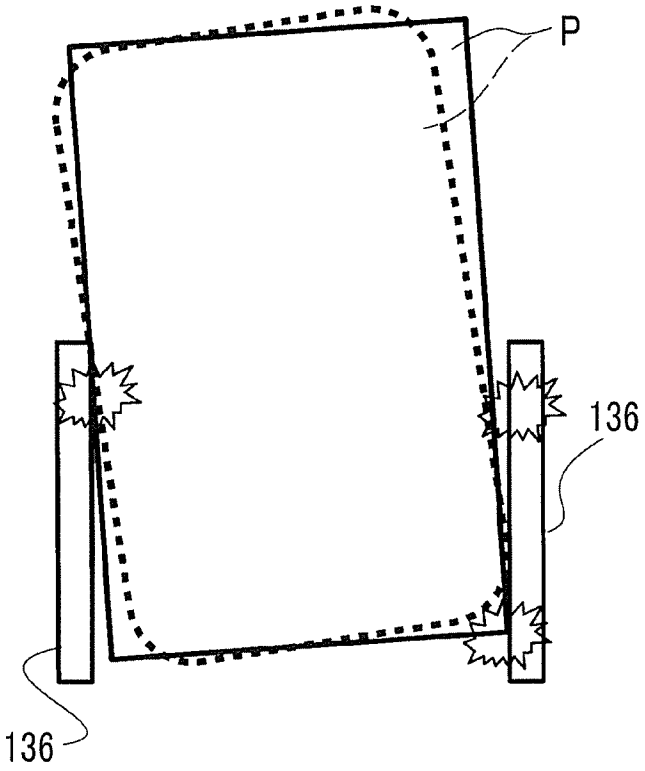
FIG. 5 is a view showing a state of occurrence of a skew in a cut sheet having a rounded corner shape.

FIG. 5 is a view showing a state of occurrence of a skew in a cut sheet having a rounded corner shape.

In addition, comparing a case where the shape of the cut sheet P is a rounded corner shape as indicated by the dotted line with a case where the shape of the cut sheet P is a normal shape as indicated by the solid line, even in a case where the gap between the cut sheet P and the side guide 136 is substantially the same, the cut sheet P having a rounded corner shape tends to have a larger inclination. As a result, as a general tendency, as compared with the cut sheet P of a normal shape, the cut sheet P of a rounded corner shape has a larger skew.

The skew occurring in a case where the cut sheet P is taken out of the sheet tray 130 is corrected when the cut sheet P reaches the registration roll 135, and the direction of the cut sheet P is corrected in the direction along the transport direction.

Figure 6:
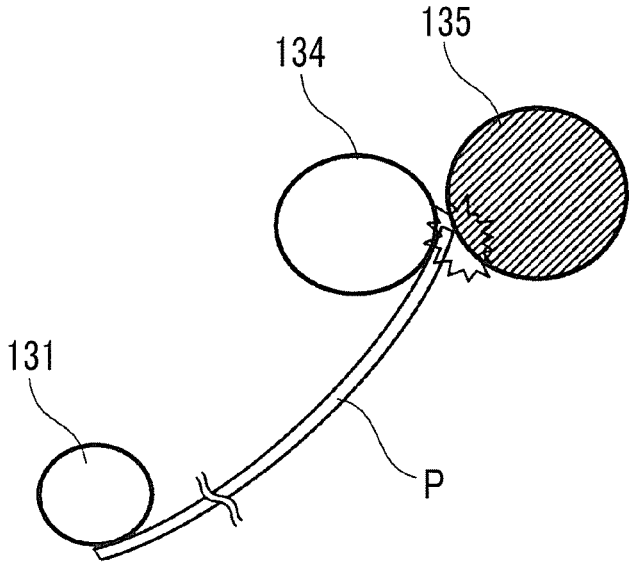
FIG. 6 is a view showing a state in which a cut sheet has reached a registration roll.

FIG. 6 is a view showing a state in which a cut sheet has reached a registration roll.

The registration roll 135 sandwiches the cut sheet P with the backup roll 134, and feeds out the cut sheet P by rotation. The backup roll 134 rotates as the registration roll 135 rotates.

In a case where the cut sheet P fed from the sheet tray 130 by the feed roller 131 reaches the registration roll 135, the leading edge thereof collides with the registration roll 135 and a collision force is generated. In addition, even after the leading edge of the cut sheet P collides with the registration roll 135, the cut sheet P continues to be pushed toward the registration roll 135 by the feed roller 131.

The skew of the cut sheet P is corrected by the collision force generated by the collision with the registration roll 135.

Figure 7:
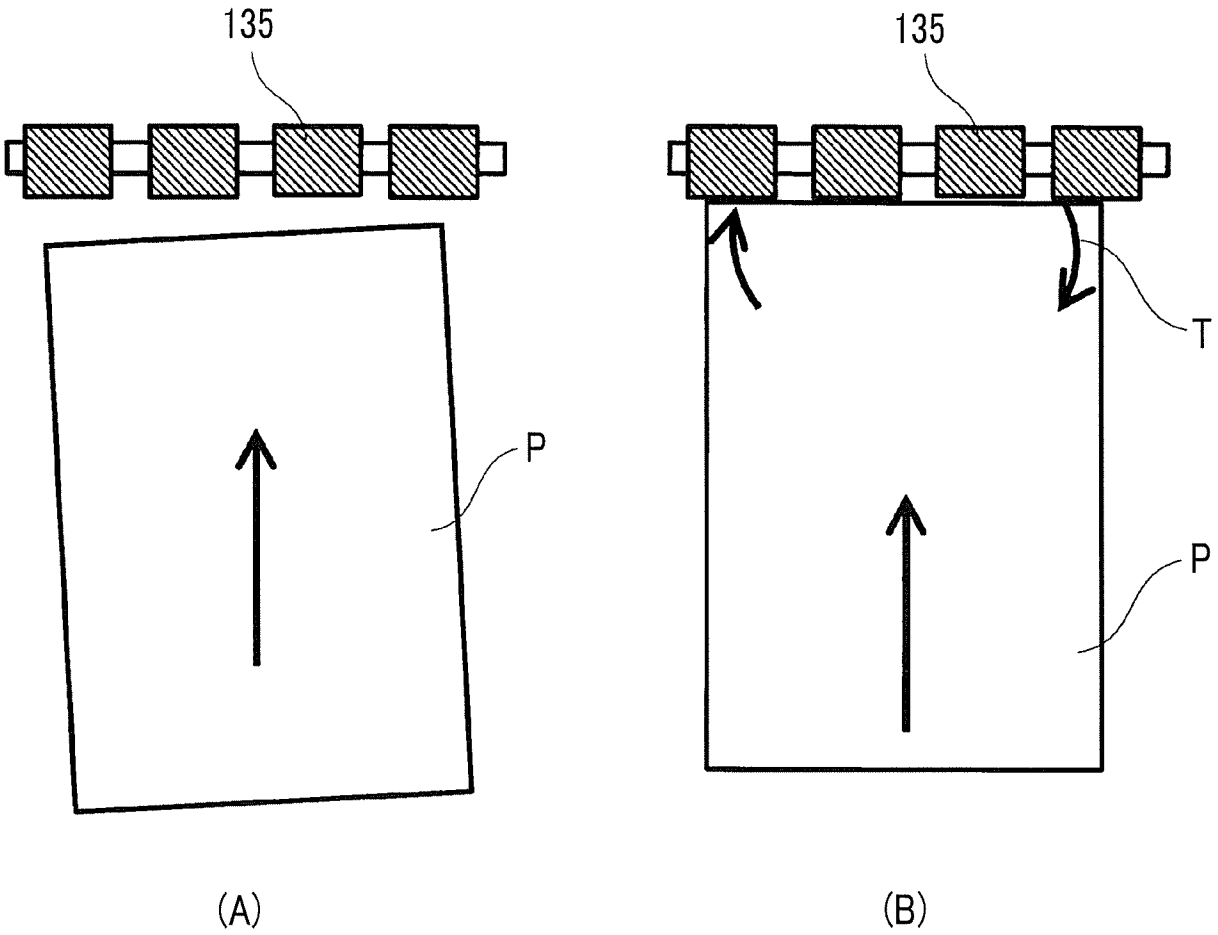
FIG. 7 is an explanatory view for explaining skew correction.

FIG. 7 is an explanatory view for explaining skew correction.

FIG. 7 shows a time of transport (A) in which the cut sheet P is skewed and a time of correction (B) in which the cut sheet P collides with the registration roll 135.

The cut sheet P skewed at the time of transport (A) is directed to the registration roll 135 while being inclined to the transport direction indicated by the arrow in FIG. 7. At the time of correction (B), the leading edge of the cut sheet P collides with the registration roll 135 to generate a collision force, and a torque T is generated on the cut sheet P due to the collision force. The skew of the cut sheet P is corrected by the torque T, and the direction of the cut sheet P is corrected so as to approach the transport direction.

In a case where the skew occurring at the time of transport (A) is small, the direction of the cut sheet P is aligned in the transport direction at the time of correction (B). On the other hand, in a case where the skew occurring at the time of transport (A) is large, even in a case where the direction of the cut sheet P is corrected at the time of correction (B), the inclination of the cut sheet P with respect to the transport direction remains. In a case where the cut sheet P passes through the registration roll 135, there is no effect of correcting the skew, so the skew remaining after the correction is also present during the subsequent image formation.

Figure 8:
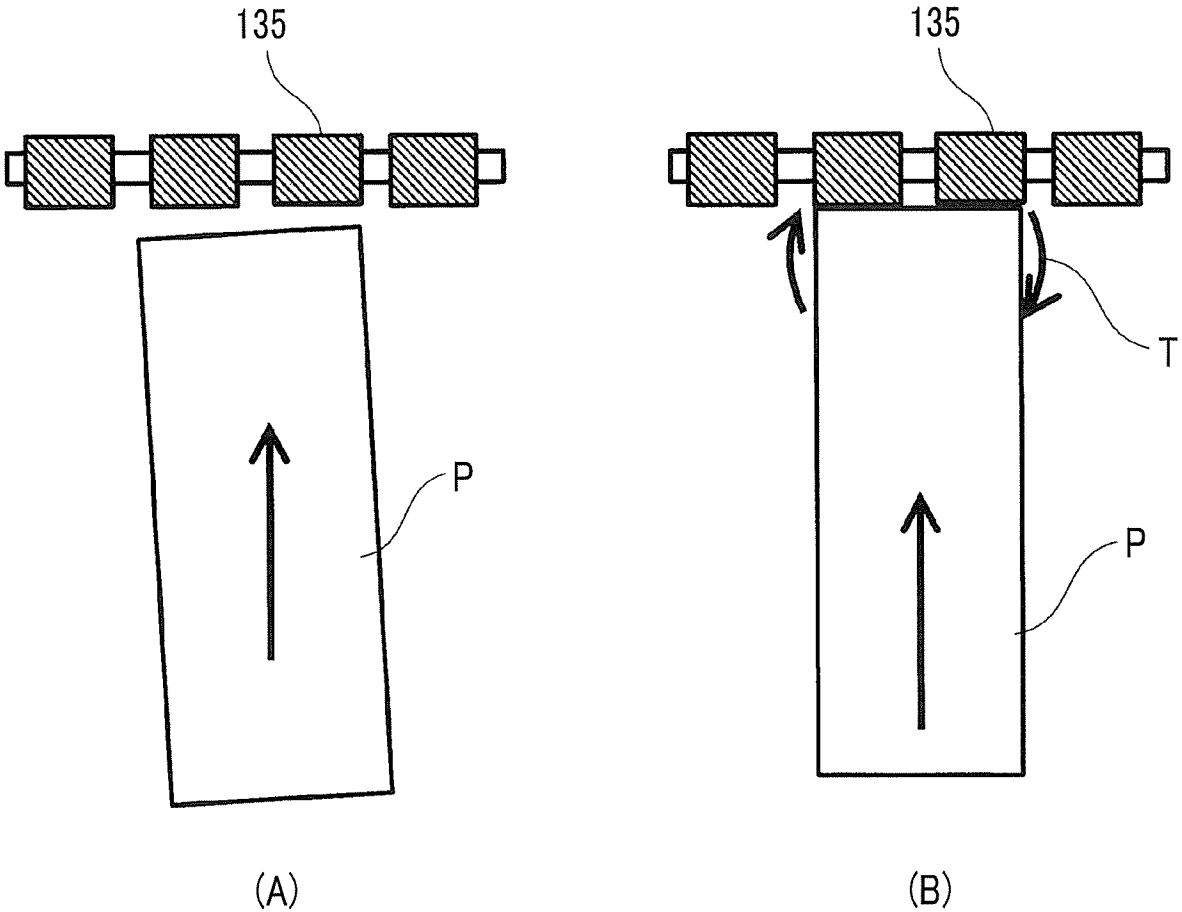
FIG. 8 is an explanatory view for explaining skew correction in a narrow cut sheet.

FIG. 8 is an explanatory view for explaining skew correction in a narrow cut sheet.

FIG. 8 shows a time of transport (A) and a time of correction (B), in a case where the width of the cut sheet P is narrower than the width of the cut sheet P shown in FIG. 7.

Even in a case of the cut sheet P having a narrow width, in a case where a skew occurs at the time of transport (A), the cut sheet P is directed to the registration roll 135 while being inclined to the transport direction indicated by the arrow in FIG. 8. At the correction time (B), the leading edge of the cut sheet P collides with the registration roll 135 to generate a collision force. However, in a case where the width of the cut sheet P is narrow, the torque T generated by the collision force becomes a small torque T. As a result, in the case of a cut sheet P having a narrow width, the power of correcting a skew becomes small, and the inclination of the cut sheet P with respect to the transport direction is likely to remain even after correction. That is, as a general tendency, as compared with wide cut sheets P, narrower cut sheets P have a large skew at the time of image formation.

Figure 9:
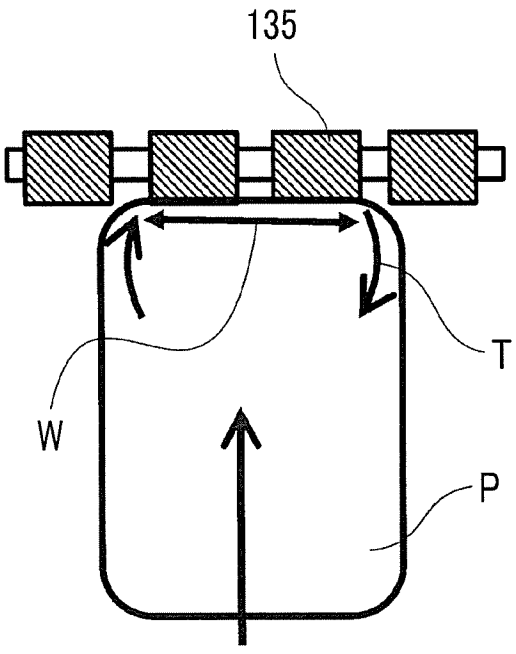
FIG. 9 is an explanatory view for explaining skew correction in a cut sheet having a rounded corner shape.
Figure 9:
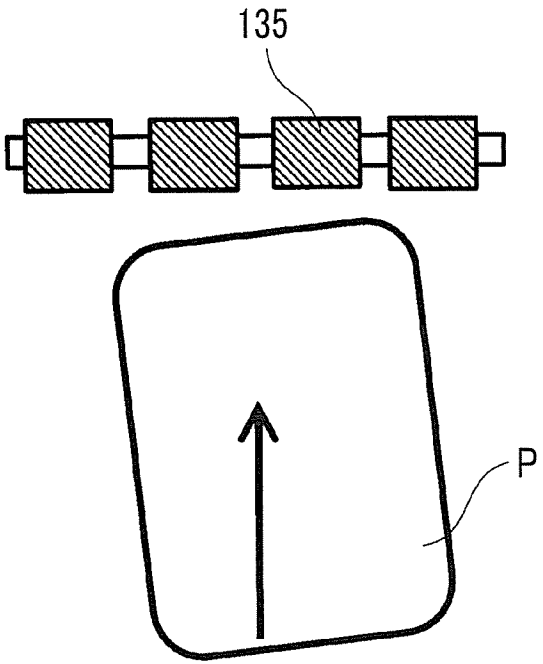

FIG. 9 is an explanatory view for explaining skew correction in a cut sheet having a rounded corner shape.

FIG. 9 shows a time of transport (A) and a time of correction (B) of the cut sheet P having a rounded corner shape.

Even in a case of the cut sheet P of a rounded corner shape, in a case where a skew occurs at the time of transport (A), the cut sheet P is directed to the registration roll 135 while being inclined to the transport direction indicated by the arrow in FIG. 8. At the correction time (B), the leading edge of the cut sheet P collides with the registration roll 135 to generate a collision force. At this time, the substantial width W of the cut sheet P colliding with the registration roll 135 is narrowed by the amount by which the corner of the cut sheet P is round, and similar to the narrow cut sheet P shown in FIG. 8, the torque T generated by the collision force becomes a small torque T. As a result, even in the case of the cut sheet P of a rounded corner shape, the power of correcting a skew becomes small, and the inclination of the cut sheet P with respect to the transport direction is likely to remain even after correction. That is, as a general tendency, as compared with the cut sheet P of a normal shape, the cut sheet P of a rounded corner shape has a larger skew at the time of image formation.

The skew correction by collision between the registration rolls 135 and the cut sheet P, described in FIGS. 7 to 9, is achieved by bending the cut sheet P at the time of collision.

Figure 10:
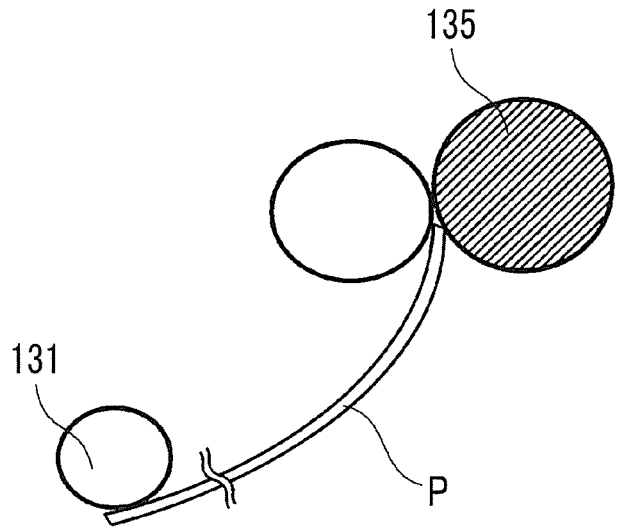
FIG. 10 is a view showing bending of a cut sheet.
Figure 10:
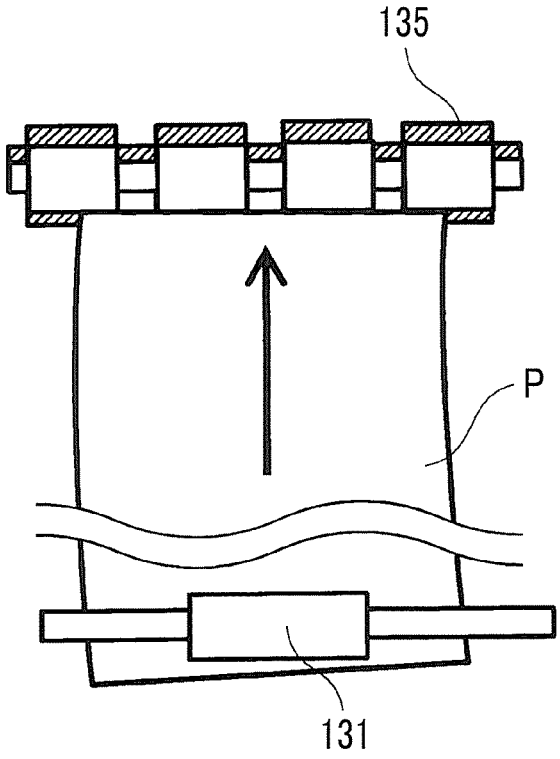

FIG. 10 is a view showing bending of a cut sheet.

FIG. 10 is a side view (A) and a front view (B) showing the state of the cut sheet P whose skew is corrected by the collision with the registration roll 135.

Even after the leading edge of the cut sheet P collides with the registration roll 135, the feeding by the feed roller 131 continues at the subsequent portion of the cut sheet P. Therefore, the cut sheet P is temporarily bent. The bending absorbs the difference in the direction of the cut sheet P which occurs on the leading edge side and the subsequent side in a case where the skew of the cut sheet P is corrected by the collision with the registration roll 135. As a result, the skew correction is performed smoothly, and the direction of the cut sheet P is corrected so as to approach the transport direction indicated by the arrow in FIG. 10.

Figure 11:
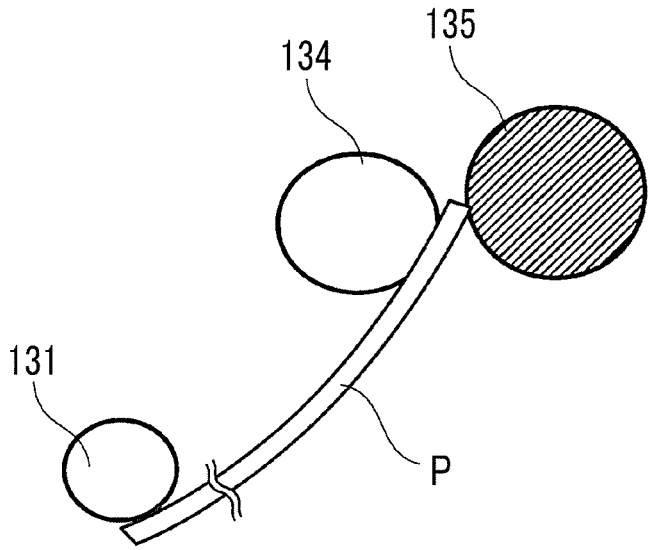
FIG. 11 is a view showing bending in a thick cut sheet.
Figure 11:
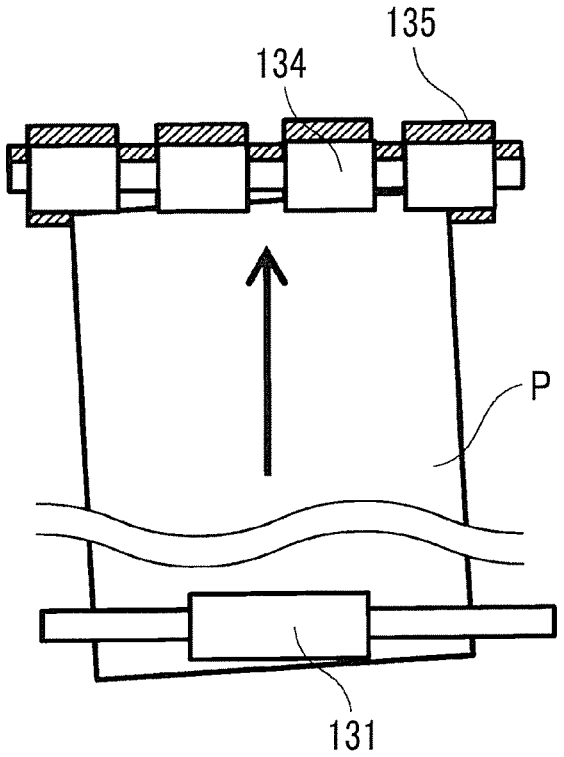

FIG. 11 is a view showing bending in a thick cut sheet.

FIG. 11 is a side view (A) and a front view (B) showing the state of bending in a case where the thickness of the cut sheet P is thicker than that of the cut sheet P shown in FIG. 10.

In a case where the thickness of the cut sheet P is large, the bending is small even in a case where the leading edge of the cut sheet P collides with the registration roll 135. Therefore, in a case where the feeding by the feed roller 131 continues at the subsequent portion, while the skew correction is insufficient, the leading edge of the cut sheet P may rush between the registration roll 135 and the backup roll 134. As a result, in the case of a thick cut sheet P, the power of correcting a skew becomes small, and the inclination of the cut sheet P with respect to the transport direction is likely to remain even after correction. That is, as a general tendency, as compared with thin cut sheets P, thick cut sheets P have a large skew at the time of image formation.

As described above, the size of the skew present at the time of image formation varies depending on the size, shape, and the like of the cut sheet P. The strength of the influence on the size of the skew is strong in the order of size, shape and thickness.

In the image forming apparatus 100 according to the first exemplary embodiment, information on the size, shape, and thickness of the cut sheet P is input by a user's operation.

Figure 12:
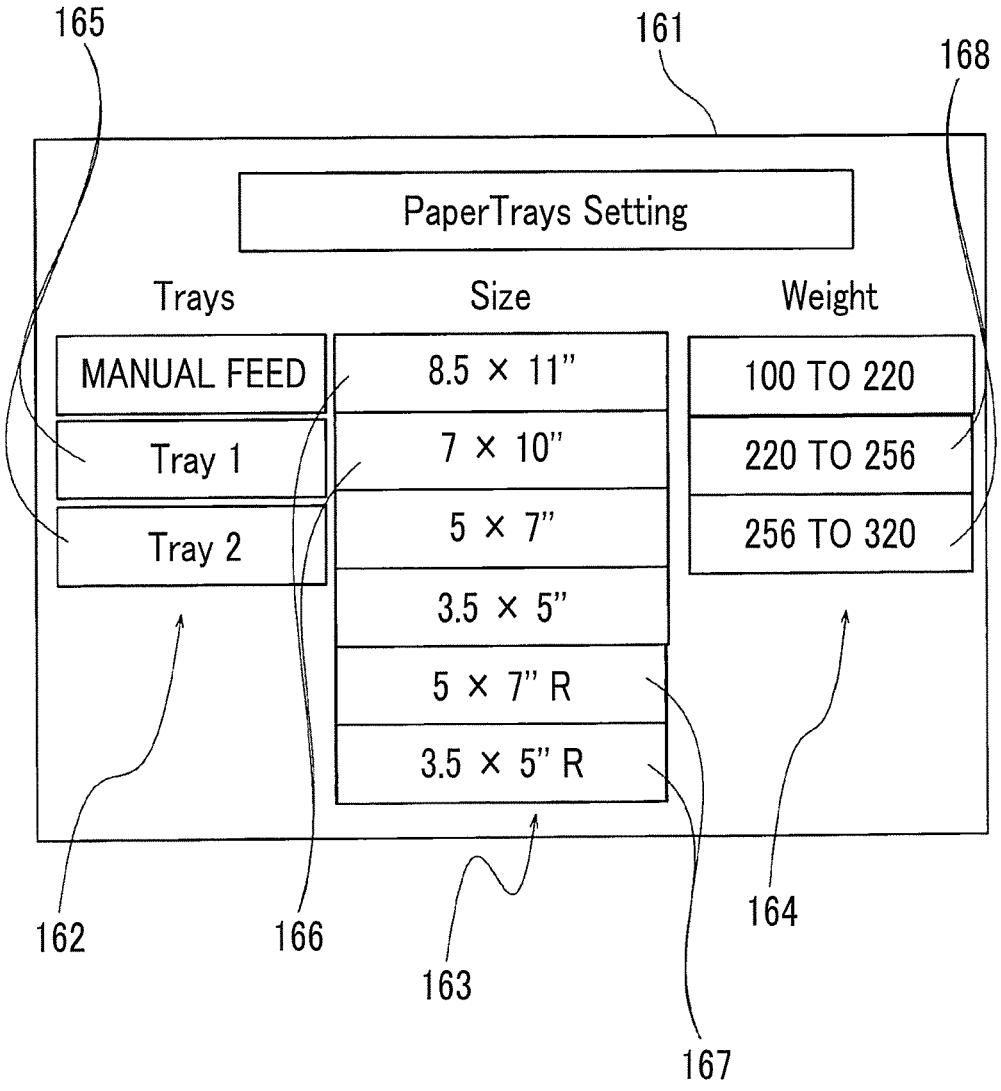
FIG. 12 is a view showing a tray setting screen on which information on cut sheets is input.

FIG. 12 is a view showing a tray setting screen on which information on cut sheets is input.

The tray setting screen 161 is a screen displayed on the display panel 160 shown in FIG. 1, and the information on the size, shape, and thickness of the cut sheet P is selectively input by the user touching an area on the tray setting screen 161. The display panel 160 displaying the tray setting screen 161 corresponds to an example of the input unit in the present invention.

On the tray selection field 162 of the tray setting screen 161, a selection buttons 165 for selecting a tray to which the information on the cut sheet P is associated is arranged.

Selection buttons 166, 167 for selecting a combination of the length in the transport direction and the width in the direction intersecting the transport direction as the size of the cut sheet P are arranged in the size selection field 163 of the tray setting screen 161. Further, along with a selection button 166 for selecting a cut sheet P having a normal shape, a selection button 167 for selecting a cut sheet P having a rounded corner shape is also arranged. That is, in the size selection field 163, three pieces of information such as the length, width, and corner shape of the cut sheet P are input.

A selection button 168 for selecting the basis weight generally used as an index representing the thickness of the cut paper P is arranged on the basis weight selection field 164 of the tray setting screen 161.

By the user operating the selection buttons 165, 166, 167, 168 on the tray setting screen 161, the information on the cut sheet P is input to the image forming apparatus 100 and stored in the control unit 180 shown in FIG. 1. Based on the information on the cut sheet P, the control unit 180 selectively uses the protrusion amount 210 at the normal time (A) and the protrusion amount 230 at the countermeasure time (C) as shown in FIG. 2. The control unit 180 corresponds to an example of a protrusion amount setting unit in the present invention.

Figure 13:
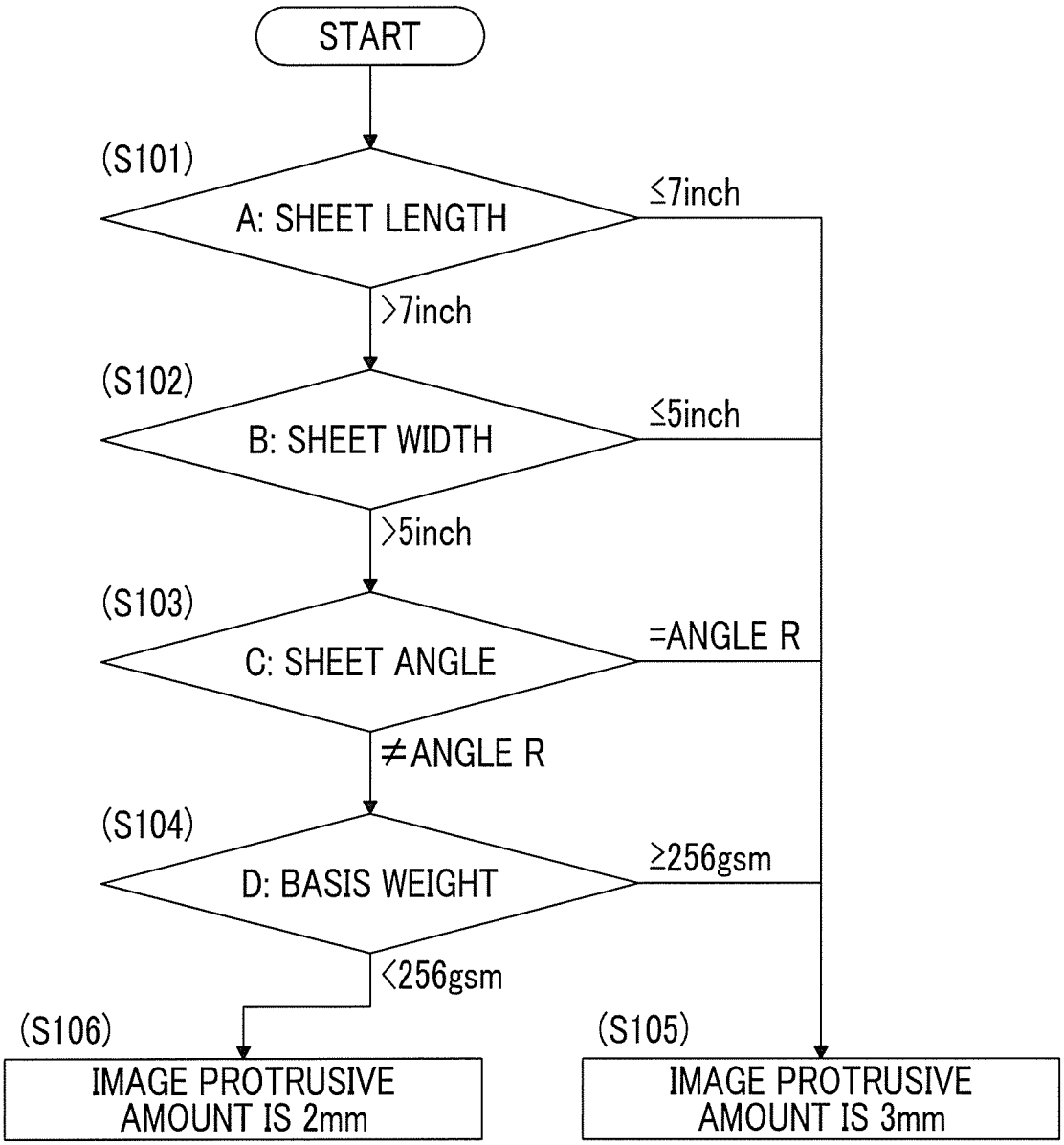
FIG. 13 is a flowchart showing control for selectively using the protrusion amount.

FIG. 13 is a flowchart showing control for selectively using the protrusion amount.

In a case where the user instructs the image forming apparatus 100 to execute a so-called job, the control shown in the flow of FIG. 13 is executed.

In a case where this control is started, the control unit 180 checks the information on the cut sheet P associated with the sheet tray 130 selected by the user for image formation. The control unit 180 checks the length of the cut sheet P (that is, the sheet length) in step S101, and in a case where the length is 7 inches or less, the skew is large. Therefore, the control unit 180 proceeds to step S105 and sets the protrusion amount to 3 mm, for example. This protrusion amount corresponds to the wide protrusion amount 230 at the time of countermeasure (C) shown in FIG. 2.

In a case where it is determined in step S101 that the length of the cut sheet P is longer than 7 inches, the control unit 180 proceeds to step S102. The control unit 180 checks the width of the cut sheet P (that is, the sheet width) in step S102, and in a case where the width is 5 inches or less, the skew is large. Therefore, the control unit 180 proceeds to step S105 and sets the protrusion amount to 3 mm wide.

In a case where it is determined in step S102 that the width of the cut sheet P is wider than 5 inches, the control unit 180 proceeds to step S103. The control unit 180 checks the shape of the cut sheet P in step S103, and in a case where the shape is a rounded corner shape, the skew is large. Therefore, the control unit 180 proceeds to step S105 and sets the protrusion amount to 3 mm wide.

In a case where it is determined in step S103 that the shape of the cut sheet P is a normal shape, the control unit 180 proceeds to step S104. The control unit 180 checks the basis weight of the cut sheet P in step S104, and in a case of the cut sheet P having the basis weight of 256 gsm or more, the skew is large. Therefore, the control unit 180 proceeds to step S105 and sets the protrusion amount to 3 mm wide.

In a case where it is determined in step S104 that the basis weight is less than 256 gsm, the skew is small. Therefore, the control unit 180 proceeds to step S106 and sets the protrusion amount to 2 mm. This protrusion amount corresponds to the narrow protrusion amount 210 at the normal time (A) shown in FIG. 2.

Thus, in the first exemplary embodiment, selectively use of the protrusion amount corresponding to the size of the skew is performed based on the information on the cut sheet P. Since the protrusion amount is selectively used in accordance with the size of the skew, an appropriate protrusion amount is set even in a case where the skew occurs.

Here, although an example in which the setting of the protrusion amount is switched only in one step has been described, the setting of the protrusion amount may be switched in a plurality of steps. In such multi-step switching, as an example, control may be performed as follows. In a case where the length of the cut sheet P is short and the width is narrow, the skew is large, so the protrusion amount is set to 4 mm, for example. Further, in a case where the shape of the cut sheet P is a rounded corner shape and the thickness of the cut sheet P is large, the skew is moderate, so the protrusion amount is set to 3 mm, for example. Further, the skew is small for the other cut sheets P, so the protrusion amount is set to 2 mm, for example.

Next, a second exemplary embodiment of the present invention will be described. The second exemplary embodiment is an exemplary embodiment similar to the first exemplary embodiment except that the size of the cut sheet P is obtained by measurement, and therefore, the description will be focused on the difference, and the redundant description will be omitted.

Figure 14:
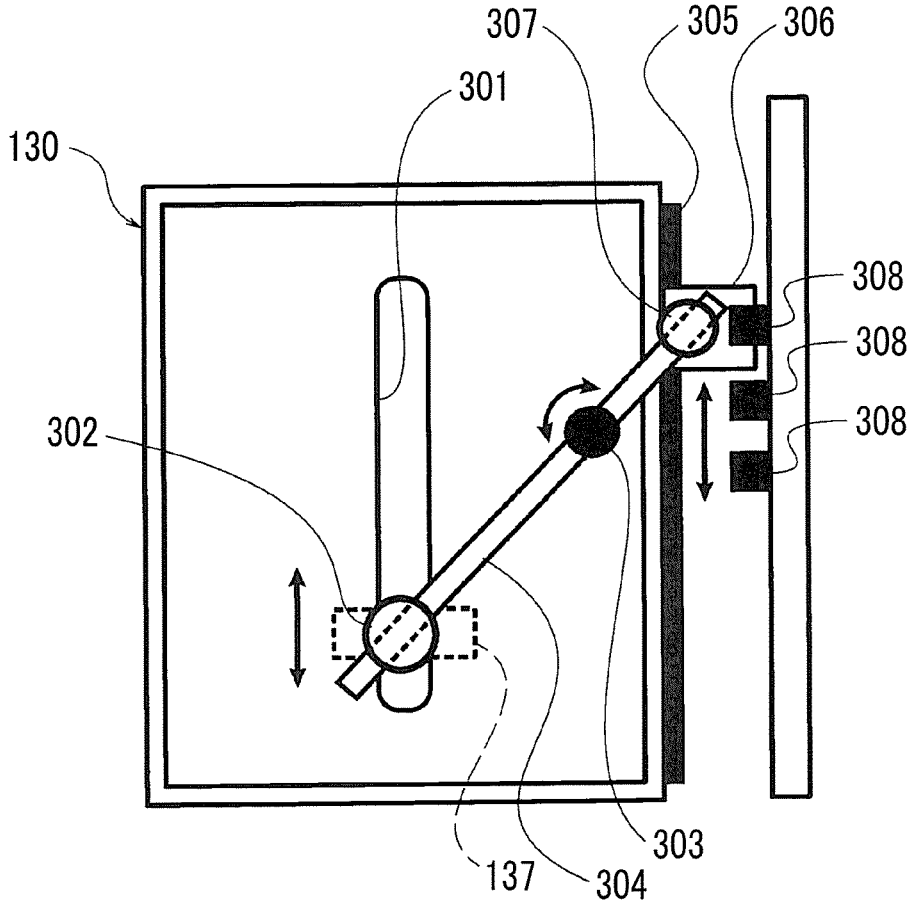
FIG. 14 is a view showing a measurement mechanism of the size of a cut sheet in a second exemplary embodiment.

FIG. 14 is a view showing a measurement mechanism of the size of a cut sheet in the second exemplary embodiment.

FIG. 14 shows the lower surface side of the sheet tray 130, and as an example, a mechanism which measures the length of the cut sheet by measuring the position of the end guide 137 is shown. The measurement mechanism shown in FIG. 14 corresponds to an example of the medium measurement unit according to the exemplary embodiment of the present invention.

The end guide 137 moves in the vertical direction of FIG. 14 along a slit 301 provided on the bottom plate of the sheet tray 130. The end guide 137 is moved by the user in accordance with the length of the cut sheet stored in the sheet tray 130. A rotating portion 302 protruding to the lower surface side of the sheet tray 130 is rotatably fixed to the end guide 137. A rotating bar 304 which rotates around a fulcrum 303 passes through the rotating portion 302 of the end guide 137.

A guide rail 305 is provided on the side of the sheet tray 130, and a moving plate 306 moves along the guide rail in the vertical direction in FIG. 14. A rotating portion 307 protruding to the lower surface side of the sheet tray 130 is rotatably fixed to the moving plate 306. The rotating bar 304 also passes through the rotating portion 307 of the moving plate 306. The moving plate 306 is connected to the end guide 137 through the rotating bar 304, and in a case where the end guide 137 moves, the moving plate 306 also moves in conjunction.

A plurality of optical sensors 308 are provided at positions facing the guide rail 305. Since the optical sensor 308 has a structure in which the light source and the light receiving element face in the depth direction in FIG. 14, in a case where the moving plate 306 enters between the light source and the light receiving element, the light is blocked and the position of the moving plate 306 is detected. In a case where the position of the moving plate 306 is detected, the position of the end guide 137 with which the moving plate 306 moves in conjunction is also detected.

In the second exemplary embodiment, the length of the cut sheet stored in the sheet tray 130 is measured by detecting the position of the end guide 137 by using such a measurement mechanism. In the second exemplary embodiment, the position of the side guide 136 (see FIG. 5) is also detected by the measurement mechanism similar to the measurement mechanism shown in FIG. 14 and the width of the cut sheet is measured. Then, based on the length and width of the cut sheet obtained by these measurements, selective use of the protrusion amount according to the size of the skew is executed as in the first exemplary embodiment.

Next, a third exemplary embodiment of the present invention will be described. The third exemplary embodiment is an exemplary embodiment similar to the first exemplary embodiment except that the size of the skew (for example, the amount of skew) is measured, and therefore, the description will be focused on the difference, and the redundant description will be omitted.

As described above, the skew of the cut sheet P is corrected at the time of collision with the registration roll 135, the measurement of the amount of skew is performed on the cut sheet P which has passed through the registration roll 135.

Figure 15:
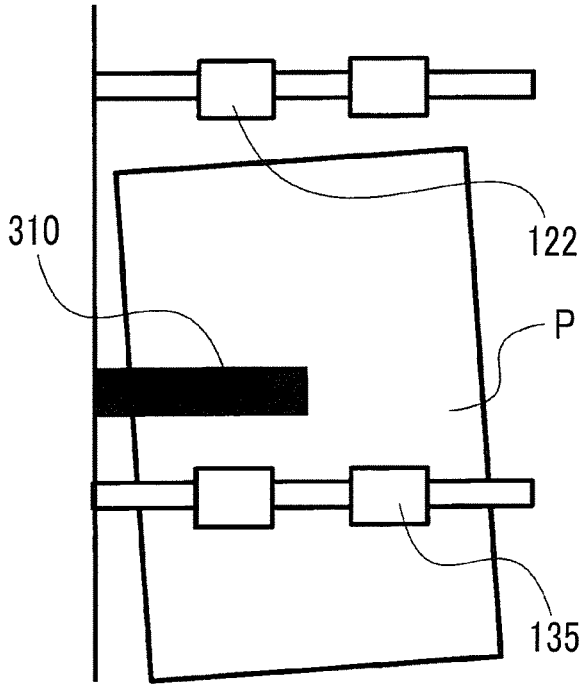
FIG. 15 is a view showing a measurement mechanism of a skew amount in a third exemplary embodiment.

FIG. 15 is a view showing a measurement mechanism of a skew amount in the third exemplary embodiment.

In the third exemplary embodiment, the side edge sensor 310 is used to measure the skew amount of the cut sheet P. The side edge sensor 310 is a sensor array provided between the registration roll 135 and the driven roll 122, and optically detects the position of the edge extending along the transport direction for the cut sheet P transported by the registration roll 135 upward in FIG. 15. The detection value by the side edge sensor 310 is used to adjust the formation position of the toner image, or the like, but in the third exemplary embodiment, the side edge sensor 310 is also used to measure the skew amount, so an increase in the number of parts is suppressed. The side edge sensor 310 corresponds to an example of the inclination measurement unit according to the exemplary embodiment of the present invention, and also corresponds to an example of the edge detector according to the exemplary embodiment of the present invention.

Figure 16:
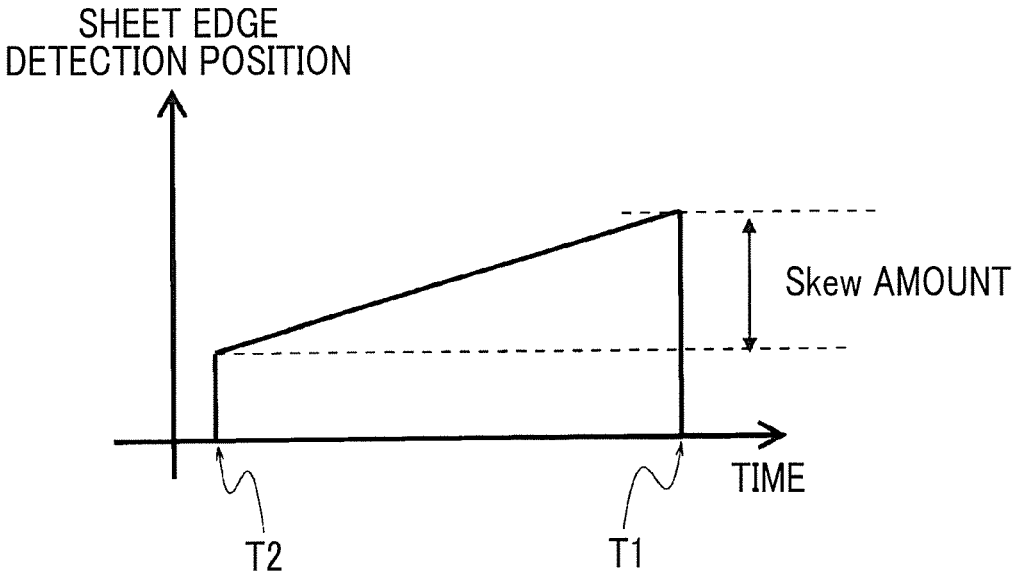
FIG. 16 is a view showing a method of measuring the skew amount of a cut sheet P from a detection value of a side edge sensor.

FIG. 16 is a view showing a method of measuring the skew amount of the cut sheet P from a detection value of the side edge sensor.

FIG. 16 shows a graph representing the time lapse of the detection value of the side edge sensor 310, the horizontal axis of the graph shows the time, and the vertical axis of the graph shows the position of the edge detected by the side edge sensor.

The amount of skew is measured by obtaining a difference between detected positions at two time points T1, T2 separated by a predetermined specific elapsed time, which is shorter than the time for the cut sheet P to reach the driven roll 122 from the registration roll 135. In the third exemplary embodiment, unlike the first exemplary embodiment, the protrusion amount is selectively used depending on the skew amount measured in this manner. That is, in the first exemplary embodiment, the selective use indirectly according to the skew amount based on the information of the cut sheet P is performed, whereas in the third exemplary embodiment, the selective use directly according to the skew amount is performed, and the accuracy of selective use is high.

Next, a fourth exemplary embodiment of the present invention will be described. The fourth exemplary embodiment is an exemplary embodiment similar to the third exemplary embodiment except that the method of measuring the skew amount is different, and therefore, the description will be focused on the difference from the third exemplary embodiment, and the redundant description will be omitted.

Figure 17:
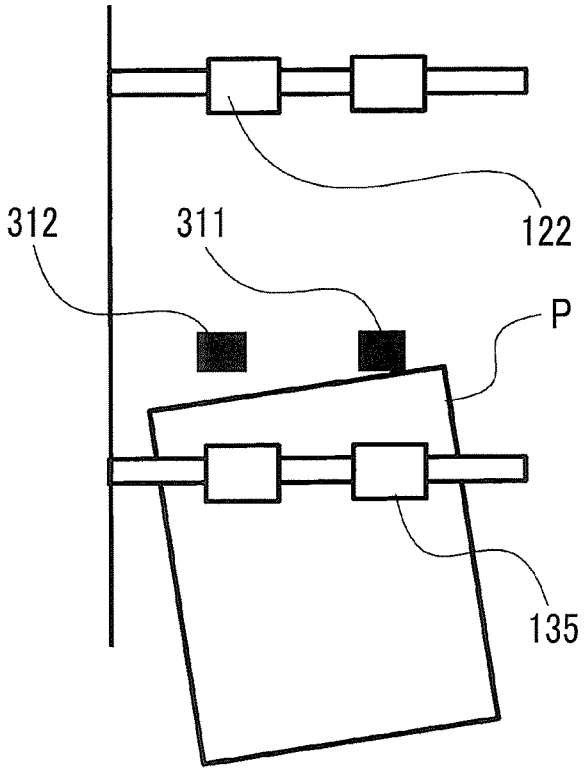
FIG. 17 is a view showing a measurement mechanism of a skew amount in a fourth exemplary embodiment.

FIG. 17 is a view showing a measurement mechanism of a skew amount in the fourth exemplary embodiment.

In the fourth exemplary embodiment, two passage sensors 311, 312 for detecting the passage of the cut sheet P are used to measure the skew amount of the cut sheet P. The passage sensors 311, 312 are reflection type sensors provided between the registration roll 135 and the driven roll 122, and detect the presence or absence of the cut sheet P transported by the registration roll 135 upward in FIG. 17 as a binary value. The two passage sensors 311, 312 correspond to an example of the inclination measurement unit according to the exemplary embodiment of the present invention.

Figure 18:
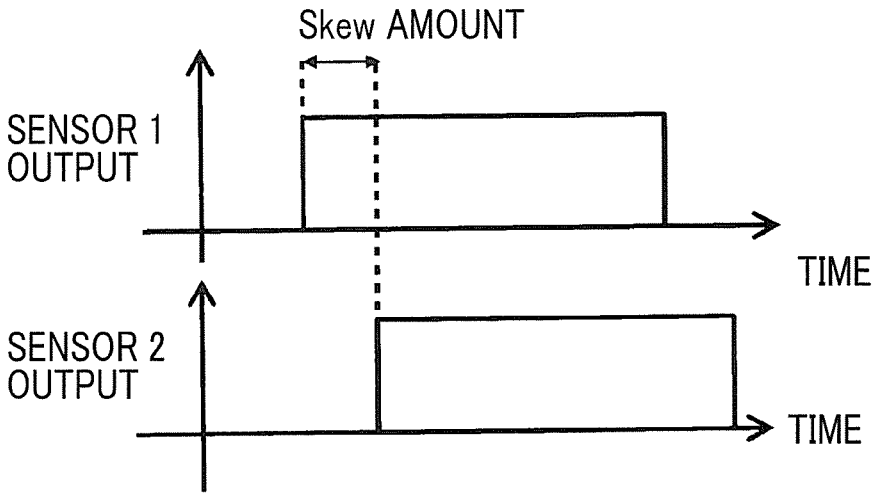
FIG. 18 is a view showing a method of measuring the skew amount of the cut sheet P from a detection value of a passage sensor.

FIG. 18 is a view showing a method of measuring the skew amount of the cut sheet P from a detection value of a passage sensor.

FIG. 18 shows a graph representing the time lapse of the detection value of each of the passage sensors 311, 312, the horizontal axis of the graph shows the time, and the vertical axis of the graph shows the presence or absence of the cut sheet P detected by each of the passage sensors 311, 312.

The skew amount is measured by obtaining the difference in detection timings of the cut sheet P by the two passage sensors 311, 312. In the fourth exemplary embodiment, as in the third exemplary embodiment, the protrusion amount is selectively used depending on the skew amount measured in this manner. Even in the fourth exemplary embodiment, selective use is performed directly according to the skew amount, and the accuracy of selective use is high.

Next, a fifth exemplary embodiment of the present invention will be described. The fifth exemplary embodiment is an exemplary embodiment similar to the first exemplary embodiment except that the shape of the cut sheet is obtained by measurement, and therefore, the description will be focused on the difference, and the redundant description will be omitted.

Figure 19:
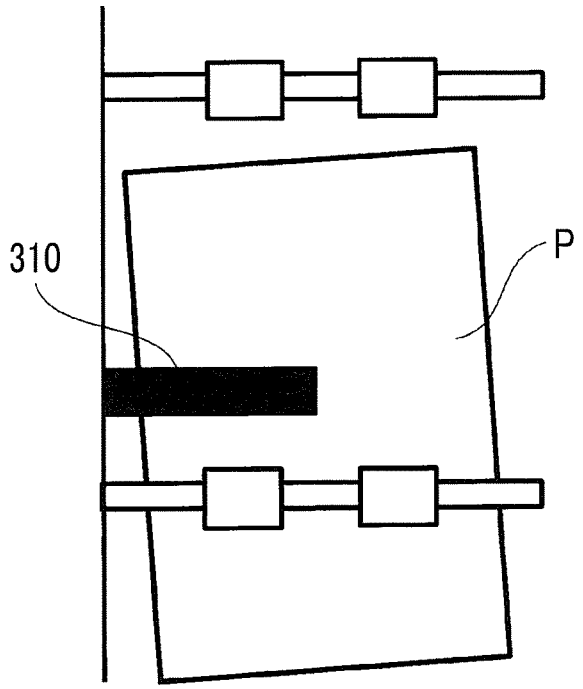
FIG. 19 is a view showing a measurement mechanism of the shape of a cut sheet in a fifth exemplary embodiment.
Figure 19:
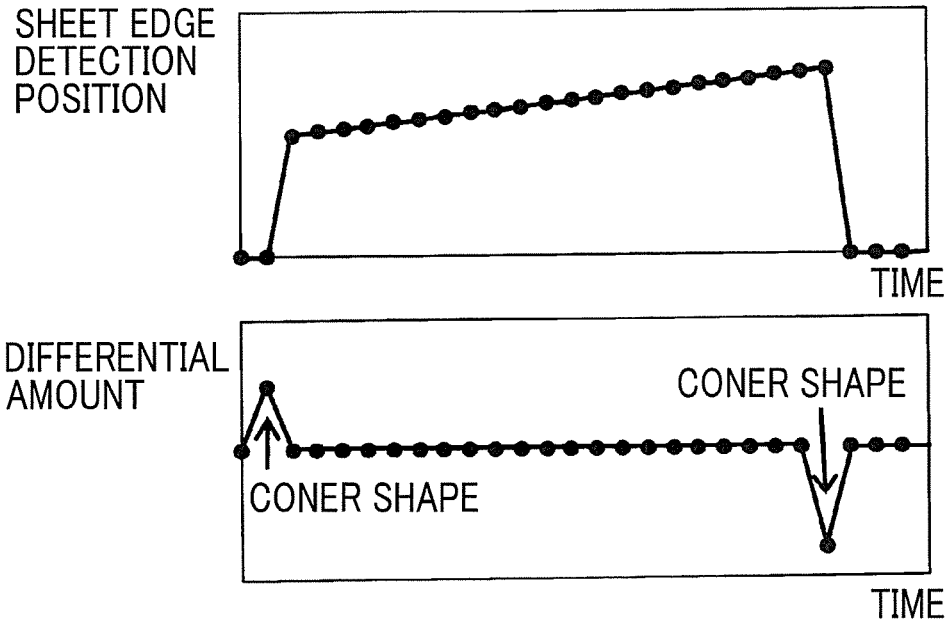

FIG. 19 is a view showing a measurement mechanism of the shape of a cut sheet in a fifth exemplary embodiment.

In the fifth exemplary embodiment, the side edge sensor 310 similar to that of the third exemplary embodiment is used to measure the shape of the cut sheet P.

In FIG. 19, a deployment view (A) of the side edge sensor 310 and a graph (B) of detection values by the side edge sensor 310 are shown. The horizontal axis of the graph (B) indicates time, and the vertical axis indicates the detection position of the edge by the side edge sensor 310 and the differential amount of the detection position.

The absolute value of the maximum value or the minimum value that occurs in the graph representing the differential amount of the detected position of the edge represents the sharpness of shape of the corner, and the shape of the cut sheet P is measured by calculating the absolute value of the maximum value or the minimum value. In the example shown in FIG. 19, it is measured that the shape of the cut sheet P is a normal shape. The calculation of the absolute value of the maximum value or the minimum value is performed by, for example, the control unit 180. The combination of the side edge sensor 310 and the control unit 180 in the fifth exemplary embodiment corresponds to an example of the medium measurement unit in the present invention.

Figure 20:
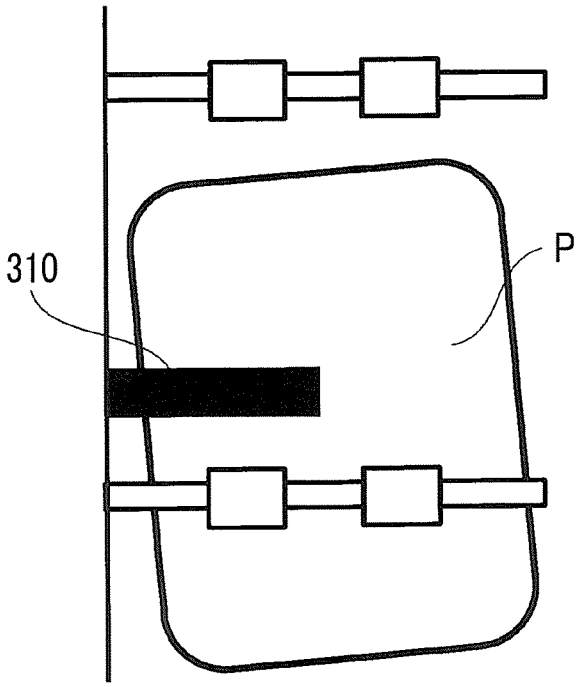
FIG. 20 is a view showing a measurement example of a cut sheet having a rounded corner shape in the fifth exemplary embodiment.
Figure 20:
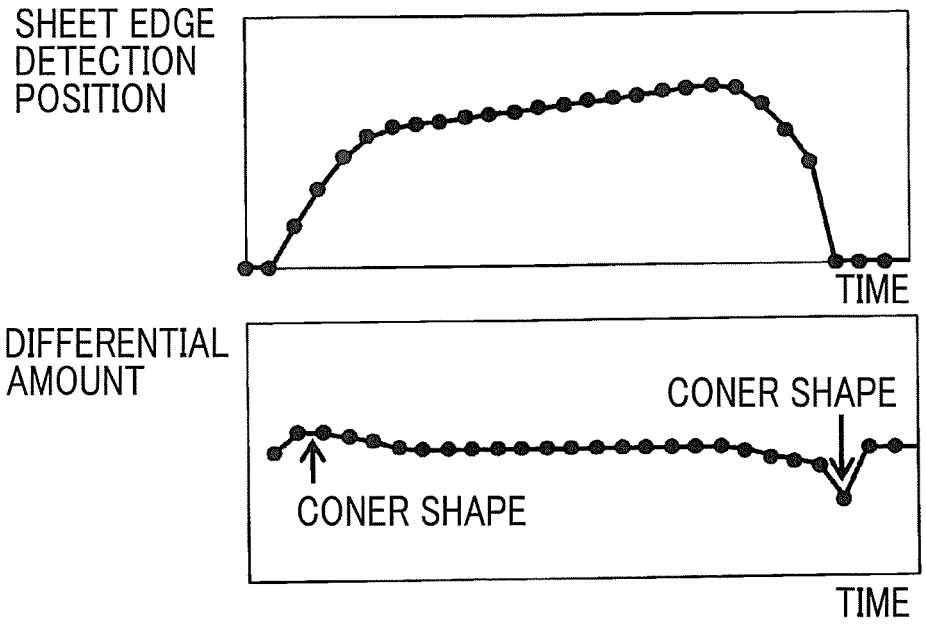

FIG. 20 is a view showing a measurement example of a cut sheet having a rounded corner shape in the fifth exemplary embodiment.

In FIG. 20, a deployment view (A) of the side edge sensor 310 and a graph (B) of detection values by the side edge sensor 310 are shown.

In the case of the cut sheet P of a rounded corner shape, since the detection position of the edge by the side edge sensor 310 changes smoothly, the absolute value of the maximum value or the minimum value occurring in the graph representing the differential amount of the detection position of the edge is small. That is, by calculating the absolute value of the maximum value or the minimum value of such a differential amount, it is measured that the cut sheet P has a rounded corner shape.

In the fifth exemplary embodiment, the information on the shape of the cut sheet P obtained by such measurement is used to selectively use the protrusion amount, as in the first exemplary embodiment.

Next, a sixth exemplary embodiment of the present invention will be described. The sixth exemplary embodiment is an exemplary embodiment similar to the first exemplary embodiment except that the thickness of the cut sheet is obtained by measurement, and therefore, the description will be focused on the difference, and the redundant description will be omitted.

Figure 21:
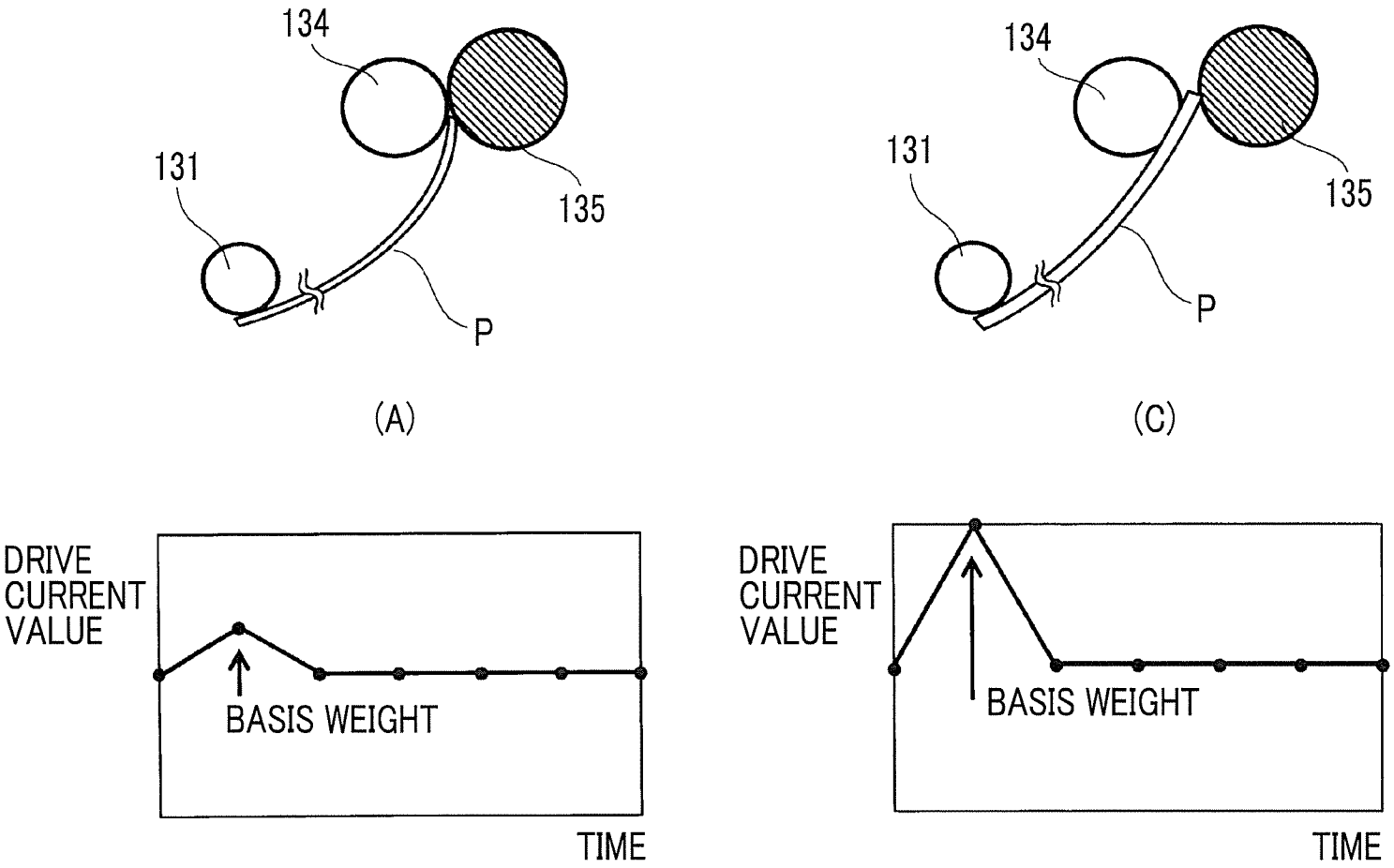
FIG. 21 is a view showing a measurement mechanism of the thickness of a cut sheet in a sixth exemplary embodiment.

FIG. 21 is a view showing a measurement mechanism of the thickness of a cut sheet in a sixth exemplary embodiment.

In the sixth exemplary embodiment, the drive current value at the feed roll 131 is used to measure the thickness of the cut sheet.

As shown in the state diagram (A) of FIG. 21, in a case where the leading edge of the cut sheet P reaches the position where the registration roll 135 and the backup roll 134 contact, the leading edge of the cut sheet P is pressed down by the registration roll 135 and the backup roll 134. As a result, in the graph (B) representing the drive current value, a peak of the drive current value occurs. In the case of a thin cut sheet P, since the cut sheet P is largely bent, the peak of the drive current value is small. On the other hand, as shown in the state diagram (C), in a case where the thick cut sheet P is pressed down by the registration roll 135 and the backup roll 134, the bending of the cut sheet P is small. Therefore, a large peak occurs in the graph (D) representing the drive current value. As described above, the thickness of the cut sheet P is measured by obtaining the peak occurring in the drive current value at the feed roll 131. The peak occurring in the drive current value is calculated by, for example, the control unit 180. The combination of the feed roll 131 and the control unit 180 in the sixth exemplary embodiment corresponds to an example of a medium measurement unit in the present invention.

In the sixth exemplary embodiment, the thickness of the cut sheet P obtained by such measurement is used to selectively use the protrusion amount, as in the first exemplary embodiment.

In the above description, a color printer is shown as an example of the image forming apparatus according to the exemplary embodiment of the present invention, but the image forming apparatus according to the exemplary embodiment of the present invention may be a monochrome printer, a copier or a multifunction peripheral.

In the above description, an image engine that forms a toner image by an electrophotographic method is shown as an example of the image forming device according to the exemplary embodiment of the present invention. However, the image forming device referred to in the present invention may form an image, for example, by inkjet.

In addition, the present invention has been made for the purpose of addressing the problems described in the section "Technical Problem", but the configuration of the present invention does not prevent the diversion to other purposes in the form not to address the problem, and a form in which the configuration of the present invention is diverted is also an exemplary embodiment of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transport unit that transports a recording medium along a transport path to a formation area in which an image is formed on the recording medium;

an image forming unit that fours the image on the recording medium in the formation area; and a protrusion amount setting unit that sets a protrusion amount of the image protruding from the recording medium to a first protrusion amount in a first case, and sets the protrusion amount to a second protrusion amount larger than the first protrusion amount in a second case where the recording medium is inclined to a transport direction more than the first case, wherein the protrusion amount setting unit acquires information on the recording medium, sets the protrusion amount to the first protrusion amount, in a case where the acquired information indicates a recording medium corresponding to the first case, and sets the protrusion amount to the second protrusion amount, in a case where the acquired information indicates a recording medium corresponding to the second case, and wherein the protrusion amount setting unit acquires a shape of a corner of the recording medium as the information on the recording medium, and sets the protrusion amount to the second protrusion amount, in the second case where the corner is more blunt than the first case.

2. The image forming apparatus according to claim 1, further comprising:

a medium measurement unit that measures a shape of a corner of the recording medium to obtain the information, wherein the protrusion amount setting unit acquires the information from the medium measurement unit.

3. An image forming apparatus comprising:

a transport unit that transports a recording medium along a transport path to a formation area in which an image is formed on the recording medium;

an image forming unit that forms the image on the recording medium in the formation area; and a protrusion amount setting unit that sets a protrusion amount of the image protruding from the recording medium to a first protrusion amount in a first case, and sets the protrusion amount to a second protrusion amount larger than the first protrusion amount in a second case where the recording medium is inclined to a transport direction more than the first case, the image forming apparatus further comprising:

an inclination measurement unit that measures an inclination of the recording medium with respect to the transport direction, wherein the protrusion amount setting unit sets the protrusion amount to the first protrusion amount, in a case where the inclination measured by the inclination measurement unit corresponds to the first case, and sets the protrusion amount to the second protrusion amount, in a case where the measured inclination corresponds to the second case, and the image forming apparatus further comprising:

an edge detection unit that detects a position of an edge extending along the transport direction, among edges of the recording medium, wherein the inclination measurement unit measures the inclination using the edge detection unit.

* * * * *